US006672938B2

(12) United States Patent
del Olmo

(10) Patent No.: US 6,672,938 B2
(45) Date of Patent: Jan. 6, 2004

(54) PROCEDURE FOR EMBROIDERING BY CREATING FORMS AND CLOSING THE MARGINS OF CUT AND PRE-SHAPED BRA CUPS

(76) Inventor: David Sanchez del Olmo, Plaza Hermanos la Fuente Alcantara 1-3, Archidona, Malaga (ES)

( * ) Notice: Subject to any disclaimer, the term of this patent is extended or adjusted under 35 U.S.C. 154(b) by 0 days.

(21) Appl. No.: 10/058,579

(22) Filed: Jan. 28, 2002

(65) Prior Publication Data

US 2002/0155785 A1 Oct. 24, 2002

(51) Int. Cl.[7] ..... A41C 3/00
(52) U.S. Cl. ..... 450/90; 112/475.21
(58) Field of Search ..... 450/1, 92, 93, 450/90; 2/246, 244, 243.1; 112/475.21, 475.18, 439, 475.26

(56) References Cited

U.S. PATENT DOCUMENTS

| | | | | | |
|---|---|---|---|---|---|
| 2,354,215 | A | * | 7/1944 | Lutz | 2/244 |
| 2,592,463 | A | * | 4/1952 | Phillips | 112/475.21 |
| 2,753,564 | A | * | 7/1956 | Verreault | 450/1 |
| 2,830,590 | A | * | 4/1958 | Verreault | 450/93 |
| 4,073,299 | A | * | 2/1978 | Murata | 450/93 |

* cited by examiner

*Primary Examiner*—Gloria Hale
(74) *Attorney, Agent, or Firm*—Muserlian, Lucas and Mercanti

(57) ABSTRACT

A process for creating shapes enclosing the margins of cut and pre-shaped bra cups to embroider the same with a design without sewing or riveting any other external decorative element with a reduced production time.

1 Claim, 3 Drawing Sheets

PROCEDURE FOR EMBROIDERING BY CREATING FORMS AND CLOSING THE MARGINS OF CUT AND PRE-SHAPED BRA CUPS

The present invention refers to the procedure which allows the specific and individual embroidering of the different edges or margins of bra cups when the cup has already been cut with its pattern and pre-shaped in its different sizes. Such procedure allows for a clean embroidering and closing, without an excess of previous fabrics while adding beauty with shapes to the different cup margins. The invention of the procedure is directed towards increasing the possibilities of applying embroidered designs within the lingerie, corset and bath sectors; in cut and pre-shaped cups by applying said procedure with a flat multi-head embroidering machine.

BACKGROUND OF THE INVENTION

The different embroidered products which have been applied to pre-shaped cups are well-known. They can be fabrics and embroidered strips on flat fabrics for their later cutting, adaptation and sewing through a backstitching or riveted type of stitch, onto the cups. Embroidery on fabrics which have been cut for said type of cups prior to their pre-shaping process have also been performed. These have the inconvenience of their deformation during the process, thereby limiting the possibilities of application of all types of designs with perfect finishes, in such specific situations, which are very much desired by the designer or manufacturer. It is noteworthy to mention that with the previous applications it is not possible to embroider the margins described of a cup's fabric, whether it is a flat or pre-shaped fabric, for its later lamination in a foam cup or another filling material because it is impossible to give the same type of embroidery to the filling piece and to fasten it during the lamination or lining process with backstitching or riveting.

To avoid the inconveniences described, the holder of the present invention David Sanchez del Olmo has developed a procedure. It is the object of the request for a patent, which allows us to unitarily embroider in the desired place on the bra cup once the cup has been cut and pre-shaped, adapting the design desired by the manufacturer. This would be based on the characteristics, sizes and dimensions of the cup designed. This is a process which also takes into account the fabric and its properties in order to perform an embroidery in a novel way due to its design, adaptability and finished character with a flat multi-head embroidering machine. This process could not be performed previously. The main characteristics offered by this procedure are: the new possibility of embroidering a pre-shaped cup once it has been cut, in its different types; of simple fabric, filling, laminating or lining with fabric. To exactly place the required design on any point of said type of cup; to offer the new possibility of placing the embroidering on the edges, stylizing them with diverse shapes, according to the design, and also the advantage of closing such edges with complete neatness with the truces of the embroidery thread.

Another novelty that the aforementioned procedure offers is the possibility of making combinations of fabrics on the cups described, by joining both fabrics, in the same process, through the embroidery sequence. This union would be perfectly integrated in the design without any visible backstitch, rivet or excess fabric in the final finished product.

DESCRIPTION OF THE INVENTION

The steps to follow in this procedure are: the study of the shape and behavior of the cup and its fabric in order to avoid the possible deformations or wrinkles by manually converting into two the three dimensions of which the partial surface of the cup to be embroidered consists. This is due to the fact that it has the property of having the volume or cavity to accommodate the breasts. Once these possible problems have been eliminated the exterior cup margins are transferred to a flat surface such as design paper, thereby graphically obtaining the original pattern, from which it was cut, in two dimensions. Afterwards, it is scanned or put through a scaling table of any program of embroidery creation.

Having obtained the image to real scale, through the methods described, and visualizing them on the computer screen the task of punching the design begins. This can vary according to the designer's or manufacturer's preferences. They could now be able to perform floral, geometric or other motifs of any sort. We must point out that the first step as well as the punching process must be individually performed on all the sizes in which the model will be embroidered.

All of the designs must incorporate an initial backstitch, serving as a stop, within the cup margins because this will indicate to us where we must cut the excess fabric. It would, thereby, turn into the new shape of the exterior margin where the rest of the embroidery will later be closed. Once the backstitching has been traced, we proceed to the punching of the rest of the design. This step must be well studied so that we do not go out of the margins delimited by the backstitch, covering it and obtaining a clean and precise finish without leaving any excess exterior fabric. This would involve a specific type of stitch in each point of its course. The directions of the finishing stitches must preferably be punched in an oblique direction to that of the cutting backstitch, so that the tension exerted in this direction by the threads on the fabrics absorbs the possible excess fabric and exterior foam which we have previously cut, following the initial cutting backstitch. It is through this procedure that we obtain a perfect finish and closing in the margins by which we have embroidered, and the possibility of embroidering any type of design regardless of its degree of difficulty according to its outline.

Once we have finished the punching process we print to real scale the image of the cup that we obtained with the design traced in the desired position on it (the cup). With this we will obtain a positioning pattern. Afterwards, we place it on an assembly table, preferably with transparency light, for an exact placement of the cup to be embroidered. The pattern must be well placed on the assembly table's coordinate axis. The coordinates indicate: the origin, center and end of the embroidery with regards to the frame that will be used.

The exterior part of the frame must be placed in its corresponding fastening supports on the table, for its later closing or assembling with the opportune material. Depending on the type of design that we will embroider, they are: a layer of non-woven polyester interfacing, a layer of water soluble material or a layer of thermo-soluble plastic material. Next, we proceed to apply a temporary spray adhesive over the layer in order to hold and fasten and fix the cup on the pattern that we have mounted on the assembly table's coordinate axis.

Once we have applied the spray we proceed to the manual assembly of the cup, starting with the most convenient and easy way for this purpose, exactly matching the pattern lines with the cup's actual margins and trying not to provoke stretching nor wrinkles.

With the frame closed and the cup fixed on the layer of material with which we have it mounted, we proceed to its machine assembly. Once we have correctly positioned the machine's fastening supports we begin the embroidering process, following some steps of the embroidery sequence which was previously described. Once this has been completed, the frame is disassembled, eliminating the remaining base material whatever it may be.

DESCRIPTION OF A PREFERRED EMBODIMENT

Following the steps described in the previous section, we will perform the procedure of a preferred model which will consist of embroidering while creating waves with interior details in circular form and with a small backstitch, closing the waves margins, in the upper interior edge or neckline of a cup which has been cut, laminated on both sides, with an intermediate layer of foam and pre-shaped.

We perform the study of its characteristics in order to obtain both dimensions of the original paper pattern. We take the cup and softly press the neckline margin down until we are able to set said margin flat and with an approximate surface of about 2.5 cm below it. We must carry out this step with extreme care in order to adhere, as exactly as possible, to the curves and dimensions that have already been traced for the cup's shape in this margin. It is very important to not stretch the piece, because if this happens, the embroidery will create an undulation or stretching when the piece returns to the beginning. Taking into account what we have previously mentioned, we trace with a pencil on a sheet of paper, the resulting exterior shape. We now proceed to draw the motif to embroider on the same paper, without going outside the pattern's contour lines and trying to create a homogeneous and stylized wave with interior motifs. These interior motifs consist of parts of backstitches which descent from different points of the wave and which end in a circle.

Figure 1:
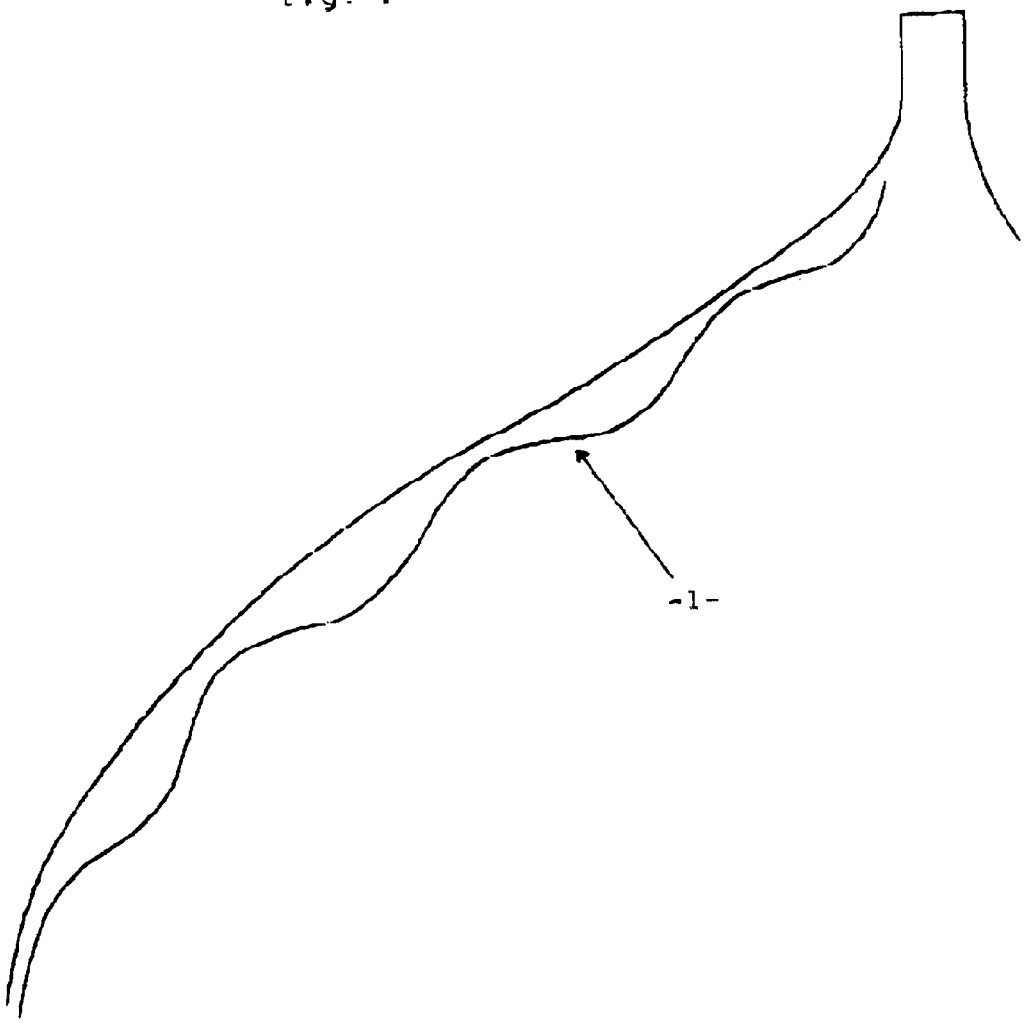
FIG. 1 is a view of the backstitch through the center of the piping.
Figure 2:
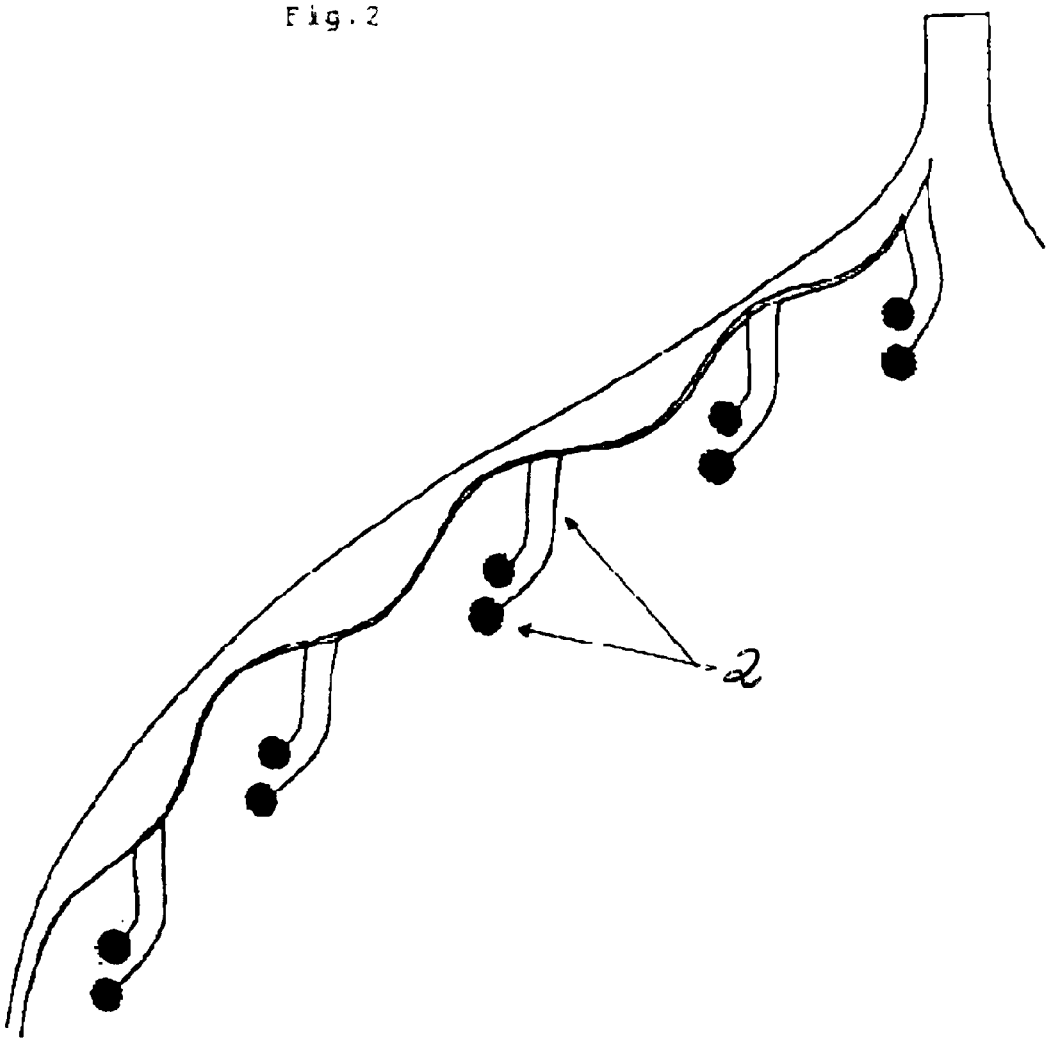
FIG. 2 is a view of the backstitch and circle motifs.
Figure 3:
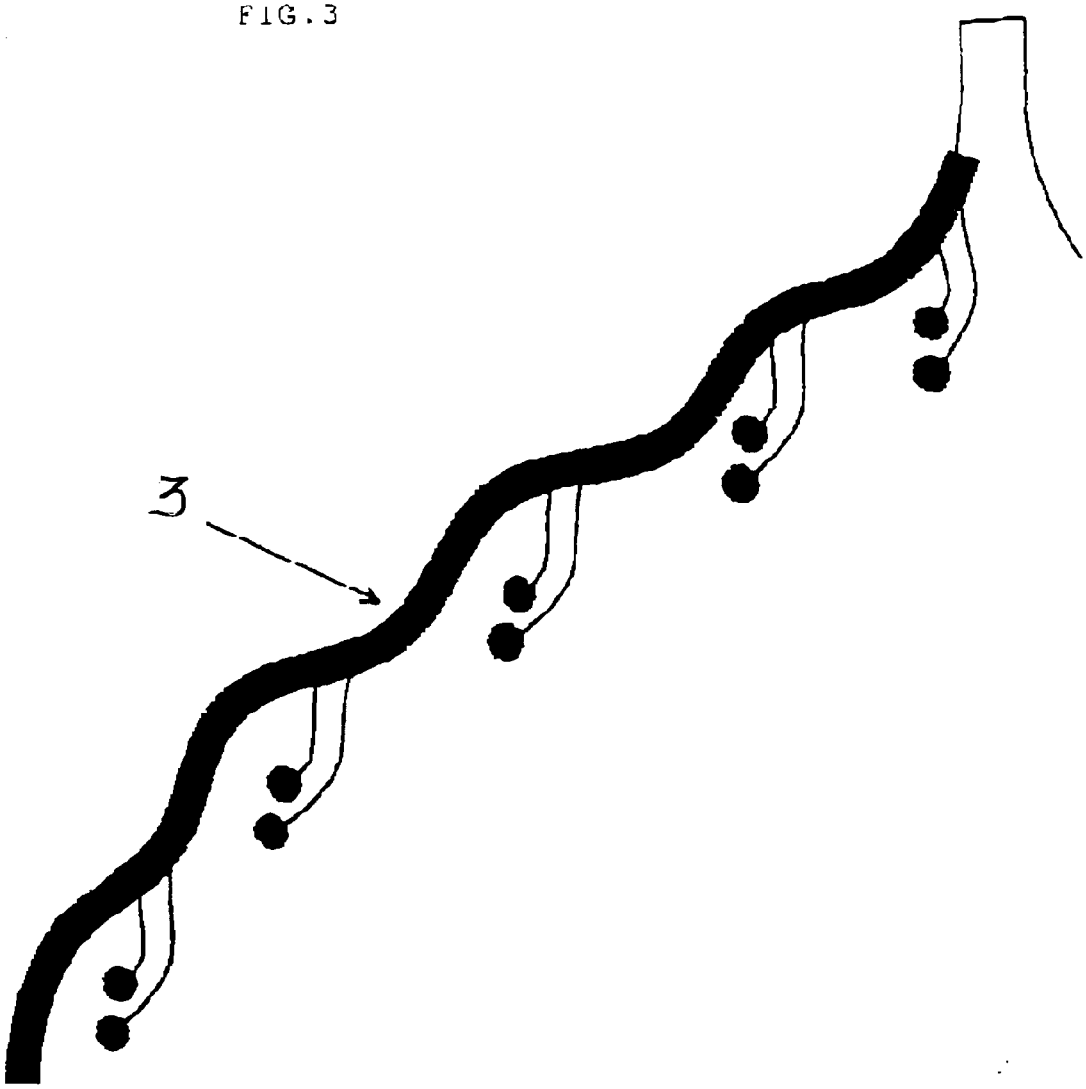
FIG. 3 is a view of the outing backstitch, in piping stitch, the wave which will draw and close the edge.

We import the real scale image pattern to the creation program through a scanner. We begin to punch a backstitch through the center of the piping drawn by the exterior wave, serving as a stop at the end (FIG. 1). Afterwards, we punch e backstitch and circle motifs (FIG. 2) Finally, we punch obliquely to the cutting backstitch, in piping stitch, the wave which will draw and close the edge (FIG. 3).

Once the entire sequence has been reviewed, we print it. This image now includes the pattern line, the design punched with the stitches and their directions, all of this centered on a coordinate axes.

After performing the assembly, we take the frame to the machine's fastening supports which must have the same center that we have designated to the pattern. We load the embroidery program in the machine's memory and we begin the sequence. Once the initial backstitching, which acts as a stop, has been embroidered, we cut the excess fabric from the external part of the wave manually with scissors. Now the machine completes the rest of the embroidery.

Once we have finished this, we disassemble the piece by pulling on one of the cup's ends, removing in the same fashion the excess interfacing which remains on the backside of the embroidery in order to obtain a clean finish.

What is claimed is:

1. A process for preparing preformed bra cups with a design comprising preforming the bra cup to accommodate a woman's breast transferring a pattern from which the pattern was cut in two dimensions, punching a design formed on the bra cup incorporating an initial backstitch serving as a stop within a cup margin to indicate where excess fabric must be cut and then punching the rest of the design, covering the bra cup and stitching finishing stitches in an oblique direction to that of a cutting backstitch whereby tension exerted by threads of fabric absorbs any excess fabric and exterior foam, placing the resulting cup on an assembly table for an exact placement of the cups, providing a layer of non-woven polyester interfacing with a layer of water soluble material with a temporary spray adhesive over the layer to hold the same in place and then removing the bra cup.

* * * * *